US005866026A

United States Patent [19]

Johnston

[11] Patent Number: 5,866,026

[45] Date of Patent: Feb. 2, 1999

[54] METHOD AND APPARATUS FOR ACCOMMODATING TOLERANCES IN A MOLD FOR CONCRETE PRODUCTS

[75] Inventor: Llewellyn L. Johnston, Vancouver, Wash.

[73] Assignee: Columbia Machine, Inc., Vancouver, Wash.

[21] Appl. No.: 768,822

[22] Filed: Dec. 18, 1996

Related U.S. Application Data

[63] Continuation-in-part of Ser. No. 458,103, Jun. 1, 1995, Pat. No. 5,648,009.

[51] Int. Cl.[6] ..... B22C 11/00

[52] U.S. Cl. ..... 249/119; 249/120; 249/129; 249/131; 249/158; 249/165

[58] Field of Search ..... 249/119, 120, 249/131, 158, 165, 129

[56] References Cited

U.S. PATENT DOCUMENTS

| | | | |
|---|---|---|---|
| 1,642,247 | 9/1927 | Krause . | |
| 1,652,855 | 12/1927 | Fernandez . | |
| 1,688,627 | 10/1928 | Long . | |
| 1,887,403 | 11/1932 | Evans . | |
| 2,091,139 | 8/1937 | Crowell . | |
| 2,121,439 | 6/1938 | Menzel . | |
| 2,904,870 | 9/1959 | Hillberg . | |
| 3,360,231 | 12/1967 | Van Hezik . | |
| 4,442,995 | 4/1984 | Grady, II . | |
| 4,451,022 | 5/1984 | Sauger . | |
| 5,059,110 | 10/1991 | Allison et al. . | |
| 5,297,772 | 3/1994 | Stefanick | 249/102 |
| 5,409,193 | 4/1995 | Baxter . | |
| 5,542,837 | 8/1996 | Johnston | 249/129 |
| 5,648,009 | 7/1997 | Johnston | 249/129 |

FOREIGN PATENT DOCUMENTS

| | | |
|---|---|---|
| 630230 | 7/1963 | Belgium . |
| 508408 | 12/1919 | France . |
| 25 56 511 | 6/1977 | Germany . |
| 856809 | 8/1981 | U.S.S.R. . |

OTHER PUBLICATIONS

Columbia Machine, "Mold Box Assembly", pp. 2.4–2.5 (1994).

Columbia Machine, "Mold Adaptor (C–200–2269)", (1980).

Columbia Machine, "Adaptor–Final Machining (B699582.25.1)", (1990).

Columbia Machine, "Mold Adaptor (D–200–3124)", (1986).

Columbia Machine, "Mold Box Assembly", pp. 2.1–2.106 (1994).

*Primary Examiner*—Thomas R. Weber
*Attorney, Agent, or Firm*—Marger, Johnson, McCollom & Stolowitz, PC

[57] ABSTRACT

A adjustable mold box assembly for forming molded concrete products includes a pair of opposed substantially parallel end plates joined at both ends by a pair of opposed substantially parallel mounting brackets. A selected plurality of partition plates extend between the end plates to define a plurality of cavities for forming molded products in accordance with the number and dimension of molded products desired. A slot is formed along the inside of each end plate substantially along the length thereof. Tabs which extend from opposing ends of each partition plate include a stud transversely mounted on the end plate using ring nuts. The opposing tabs and studs of each end plate are received in opposing end plate slots. End liners are bolted to the inside surface of each end plate over the studs on each side of each partition plate with the ring nuts bearing against the surface of the end liner. A sliding plate is receivable in the slots and positionable therealong to abut the partition plate closest to one end of the mold box assembly.

12 Claims, 3 Drawing Sheets

METHOD AND APPARATUS FOR ACCOMMODATING TOLERANCES IN A MOLD FOR CONCRETE PRODUCTS

This application is a continuation-in-part of U.S. Ser. No. 08/458,103, filed Jun. 1, 1995, U.S. Pat. No. 5,648,009.

BACKGROUND OF THE INVENTION

This invention relates generally to mold box assemblies and more particularly to such assemblies which are used to form molded products such as concrete products and which are assembled from a plurality of parts including partition plates which define boundaries of adjacent molded products.

Machines for forming concrete products such as blocks, bricks and pavers, typically utilize a rectangular mold box assembly in which concrete is compressed to form the product. One such machine is described in U.S. Pat. No. 5,059,110 to Allison et al. for APPARATUS FOR FORMING CONCRETE BLOCKS HAVING PLURAL SEPARATELY DRIVEN VIBRATOR SETS. A typical mold box assembly includes a pair of opposed substantially parallel upright end plates and a pair of opposed substantially parallel upright mounting brackets positioned at opposite ends of the end plates which together with the end plates, form a substantially rectangular mold box.

The mold box assembly is put together prior to mounting the same on the machine. In the course of creating the mold box assembly various liners, partition plates, and cores are installed in the interior of the box depending on the type of concrete product which is to be molded therein. Typically, a plurality of substantially identical blocks, bricks or pavers are formed each time the box is filled with wet concrete. When the box is assembled it is mounted on the machine via bolts secured through holes in the mounting brackets on either end of the mold box assembly. The top and bottom of the mold box assembly are open so that a steel pallet which is supported on the machine can be urged against the bottom of the box while concrete is dropped into the top of the box. Thereafter, a head plunger mounted on a vertically moveable portion of the machine lowers into the top of the mold box, thereby compressing the concrete therein and forming the molded products. The molded products are stripped out of the box through the bottom side while continuing to be supported by the pallet.

The end plates in a typical prior art mold box assembly include bores spaced at intervals equivalent to the width of the block, paver, or other product to be formed in the mold box assembly. A slot is formed along the length of each end plate so that the slots in each end plate are facing one another with the bores being formed between the slot and the outer side of each end plate.

The usual mold box assembly forms a plurality of substantially identical concrete products in cavities defined by partition plates which extend between the end plates. Each partition plate includes a tab on opposing ends thereof to which a clevis having a bolt extending from one end thereof is pinned. Each tab and clevis are received in an end plate slot with the bolt extending through one of the bores in the end plate. Thereafter a washer and nut is used to secure the partition plate on each side of the end plate. End liners are then bolted to the inner walls of each end plate between adjacent partition plates and the mold box assembly is mounted on a block forming machine.

In operation, a steel pallet is urged against the lower side of the mold box assembly and wet concrete is poured into the top of the assembly. The mold box assembly can be vibrated during filling and during compaction, when shoes mounted on the machine are urged into the top of the mold box assembly to compress the wet concrete. Sometimes, especially when forming products which require a high degree of compaction, the end plates bow outwardly when the shoes compress the concrete product.

After the product is compressed, the pallet and shoes move downwardly thereby stripping the formed product from the lower side of the mold assembly. The molded product supported by the pallet is cured to form the finished product.

An improved mold box is disclosed in applicant's U.S. patent application Ser. No. 08/373,936, now U.S. Pat. No. 5,542,837 which comprises first and second end plates which are substantially parallel with one another. At least one partition plate extends from one end plate to the other and includes first and second opposing ends which substantially abut the inner sides of the end plates. A slot formed on the inner side of the first end plate extends substantially along the length thereof. The partition plate includes a tab extending from one end thereof which is received in the slot. Locking means extends laterally from the tab. One side plate or liner is mounted on the first end plate over the slot adjacent one side of the partition plate and another side plate or liner is mounted on the first end plate over the slot adjacent the other side of the partition plate. In one aspect, the partition plate is slidable along the slot when the tab and locking means are received in the slot and is constrained from such movement by the first and second plates. In another aspect, the locking means bears against each of the pair of side plates or liners.

The above improved box is intended to allow a user to form molded blocks having a selected width which conforms to the width of the end plates selected. A noted disadvantage with this system is that the individual block widths desired do not exactly fit within the standard mold box used. Thus, specially machined partition plates of a certain thickness are used for each arrangement of partition and end plates. This process is both expensive and time-consuming in that the last partition plate used in the mold must be custom machined to the proper tolerances.

Accordingly, it would be desirable to have an adjustable adapter which can be used in a variety of partition plate arrangements within a standard mold box.

SUMMARY OF THE INVENTION

It is, therefore, an object of the present invention to provide a method and apparatus for securing partition plates in a mold box assembly which overcome the above-enumerated disadvantages associated with prior art mold box assemblies.

It is a more specific object of the present invention to provide such a method and apparatus in which the partition plates are infinitely adjustable along the length of the mold box assembly.

It is another specific object of the present invention to provide such a method and apparatus in which the end plates are constrained from bowing movement during compression of the molded product.

The present invention comprises a mold box assembly having first and second end plates opposite to and substantially parallel with one another. At least one partition plate extends from one end plate to the other and includes first and second opposing ends which substantially abut an inner side of the end plates. A slot formed on the inner side of the first end plate extends substantially along the length thereof. The partition plate includes a tab extending from one end thereof which is received in the slot. In a preferred embodiment, locking means extends laterally from the tab. A first end liner is mounted on the first end plate over the slot adjacent one side of the partition plate and a spacer is disposed intermediate the other side of the partition plate. In one aspect, the partition plate is slidable along the slot when the tab and locking means are received in the slot and is constrained from such movement by the first end liner and spacer. In another aspect, a plurality of end liners and partition plates are disposed to form individual mold elements within the mold box using the spacer as described above to maintain the distribution of the plates within the box.

The present invention also provides a method for assembling a mold box in which the first and second end plates are arranged in substantially parallel relation with one another with the slot on the first end plate facing the second end plate. Locking means which extend laterally from the partition plate tabs are preferably installed thereon. The partition plate is positioned between the end plates with the tab locking means being received in the slot and opposing ends of the partition plate substantially abutting the end plates. The partition plate is slid along the end plates to a selected location after which a first end liner is mounted on the first end plate over the slot adjacent one side of the partition plate and the spacer is positioned adjacent the other side of the partition plate for constraining movement thereof.

An method for using the assembled mold box having a substantially rectangular frame and described above is also disclosed. The method comprises positioning the plurality of partition plates within the rectangular frame; installing in the frame a substantially rectangular spacer having an expanse, disposed adjacent one of its ends, which is receivable in the end plate slots and slidable therealong; and thereafter sliding the spacer against a selected one of the partition plates such that the spacer fixedly maintains the selected one of the partition plates in position within the rectangular frame.

The foregoing and other objects, features and advantages of the invention will become more readily apparent from the following detailed description of a preferred embodiment of the invention which proceeds with reference to the accompanying drawings.

DETAILED DESCRIPTION

Figure 1:
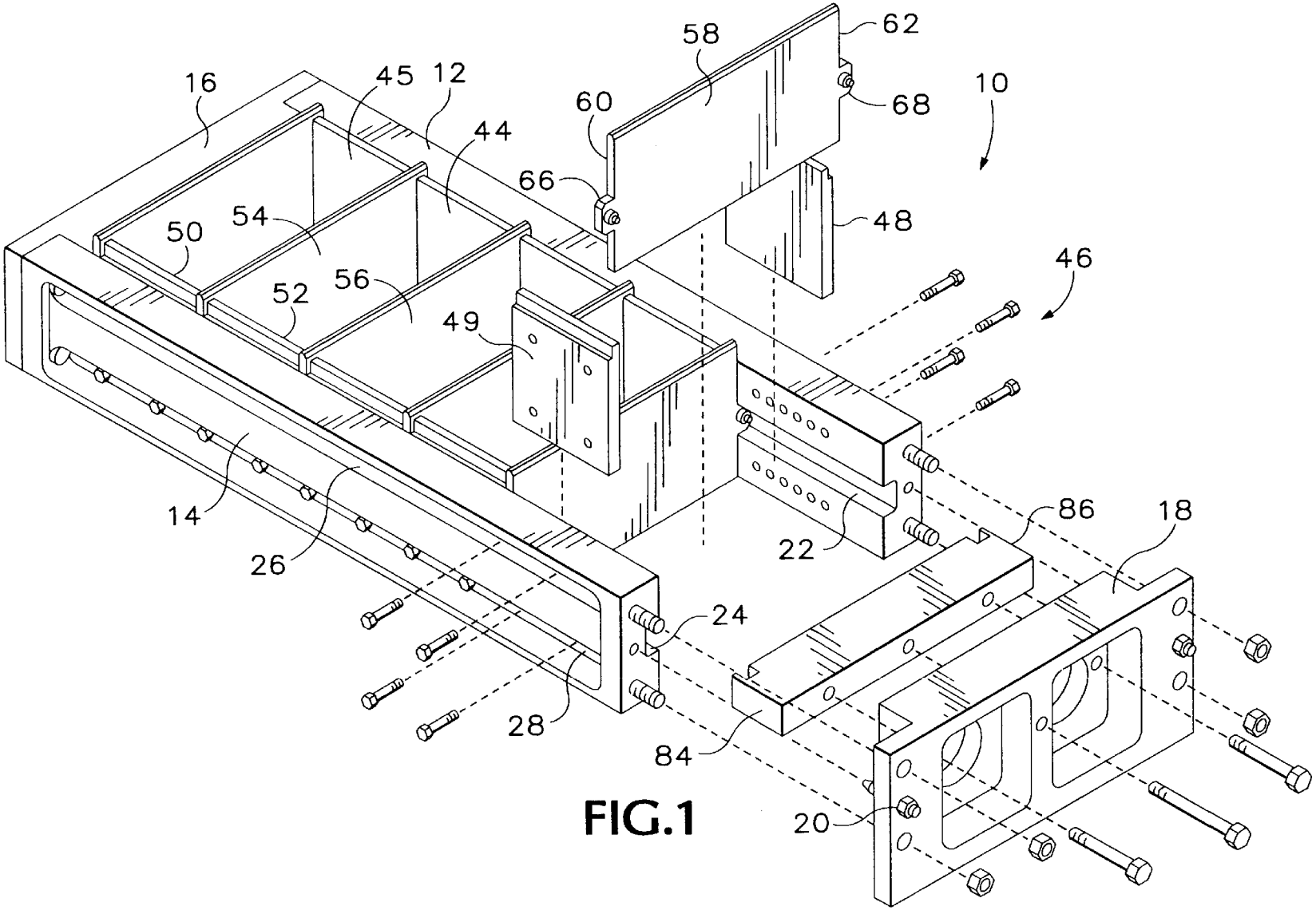
FIG. 1 is a partially exploded perspective view of a mold box assembly constructed in conformance with the present invention.

Indicated generally at 10 in FIG. 1 is a mold box assembly constructed in accordance with the present invention. Included therein is a first end plate 12, a second end plate 14, and a pair of mounting brackets 16, 18. End plates 12, 14 and mounting brackets 16, 18 are assembled to form a rectangular "box" having an open top and bottom as shown. Preferably, an alignment pin 20 and associated bolts as shown are installed on each corner as is more particularly described in U.S. patent application Ser. No. 08/361,780 filed in the U.S. Patent and Trademark Office on Dec. 22, 1994, now U.S. Pat. No. 5,752,080 and incorporated herein by reference.

Figure 2:
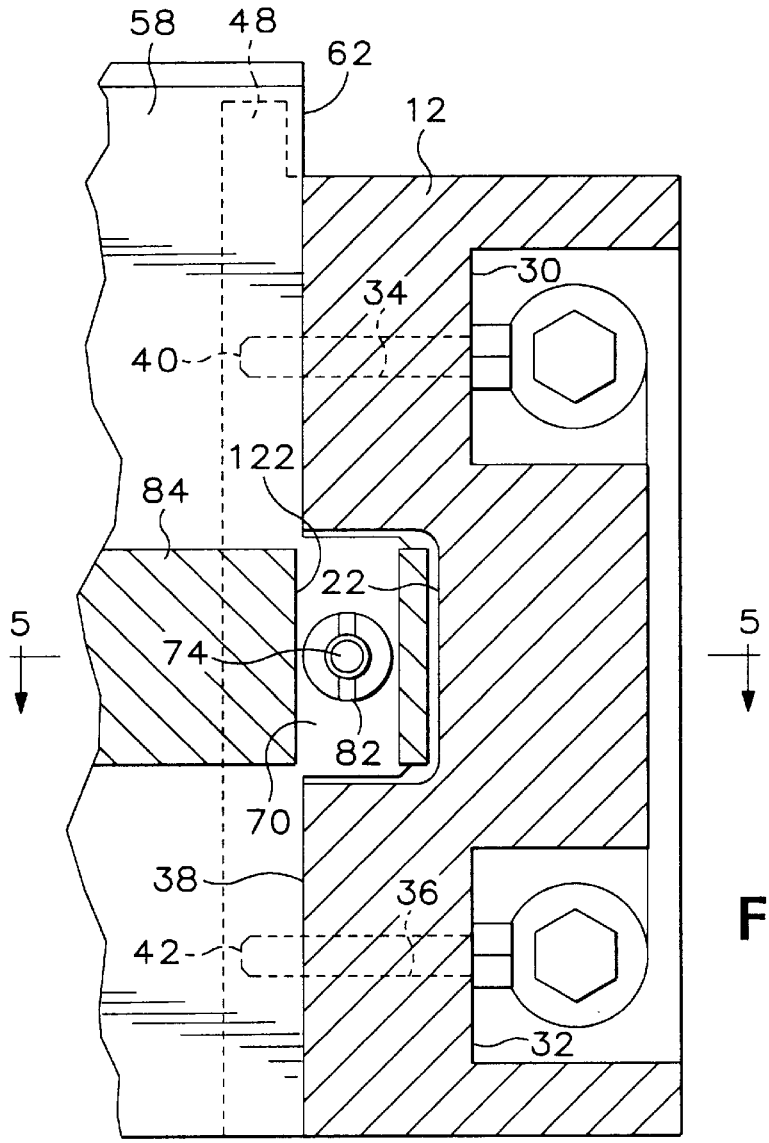
FIG. 2 is an enlarged sectional view taken along line 2—2 in FIG. 1.

End plates 12, 14 are substantially identical and include opposing slots 22, 24 along the length thereof. End plate 14 includes a pair of upper and lower slots 26, 28 in FIG. 1, which extend substantially along an upper and lower portion on the outer side of end plate 14. Similar slots 30, 32, in FIG. 2, are formed on the outer side of end plate 12. A plurality of bores, like bores 34, 36 shown in dashed lines in FIG. 2, extend between slots, like slots 30,32, respectively, and an inner surface 38 of end plate 12. Similar bores are formed in slots 26, 28 on end plate 14.

Bolts, like bolts 40, 42, are received in the bores and are used to secure end liners, like end liner 44 (viewable in FIG. 1) and end liner 45 against surface 38 of end plate 12.

Similar bolts indicated generally at 46 in an exploded view are used to secure end liner 48, also exploded, to surface 38. An opposing end liner 49 is also shown in exploded view and is attached to end plate 14 with bolts (exploded) in the same manner.

As can be seen, additional end liners, like end liners 50, 52, are mounted on an inner surface of end plate 14 using similar bolts received in slots 26, 28 of end plate 14. A plurality of partition plates, like plates 54, 56, and plate 58 (shown in exploded view) extend between end plates 12,14. Each partition plate includes first and second opposing ends, like ends 60, 62 on plate 58. Each of the partition plates includes a tab, like tabs 66, 68 on partition plate 58 in FIG. 1, which extends from the end thereof. Each tab includes a bore, like bore 72 in tab 68, therethrough. A stud is received in each bore, like stud 74 is received in bore 72 in FIG. 5. Stud 74 includes a central, unthreaded portion received in bore 72 and a pair of threaded stud ends 76, 78 which extend from either side of bore 72. Each threaded end has a commercially available ring nut 80, 82 threadably engaged therewith. The ring nuts are tightened against tab 68, using a commercially available spanner wrench in a known manner, and together with the stud are referred to herein as locking means.

As can be seen in connection with partition plate 58 in FIG. 1, each tab of each partition plate includes substantially identical locking means mounted thereon.

Consideration will now be made to the manner in which mold box assembly 10 is put together. A stud, like stud 74 is inserted in each bore on each partition plate tab and associated ring nuts are tightened on either end of the stud to provide locking means as shown in each of tabs 66, 68 on partition plate 58 in FIG. 1. Thereafter, end plates 12, 14 are positioned parallel with one another substantially as shown in FIG. 1 and end plate 16 is secured to the end thereof as previously described herein. Preferably, a conventional fixed spacer (not shown) or adjustable spacer as described below with reference to spacer 84 is secured to the interior of the mold box assembly adjacent mounting bracket 16. Next, a partition plate assembly, such including locking means on each of the partition plate tabs, is positioned between end plates 12, 14 at the ends thereof opposite mounting bracket 16 with the tabs being received in slots 24, 22. The partition plate is slid along the length of the end plates until it abuts the spacer (not shown). Thereafter a set of end liners, like end liners 45, 50, are bolted onto end plates 12, 14 as shown. Partition plate 54 is then slid along slots 22,24 in the same manner until it abuts plates 45, 50 with a ring nut bearing against plate 45, as shown generally in FIG. 5. Thereafter, plates 44, 52 are installed using the bolts received in slots 30, 32 of end plate 12 and slots 26, 28 of end plate 14. The process continues until the mold assembly is substantially assembled with the adjustable spacer 84 as described below being mounted on the mold assembly adjacent mounting bracket 18 in the same fashion as the spacer on the opposing end of assembly 10.

A substantially rectangular adjustable spacer or plate 84, shown in FIG. 1, is provided for assembly 10. Spacer 84 has an expanse, shown generally in FIG. 1 at 86, 88, disposed adjacent each of its first and second ends 90, 92. Expanses 86, 88 of spacer 84 is received in slots 22, 24 respectively, of end plates 12, 14 and slidably travel therealong. The spacer further has a leading side 94 which engages one side of partition plate 58 when the spacer is placed in its operative position as described further below.

Figure 4:
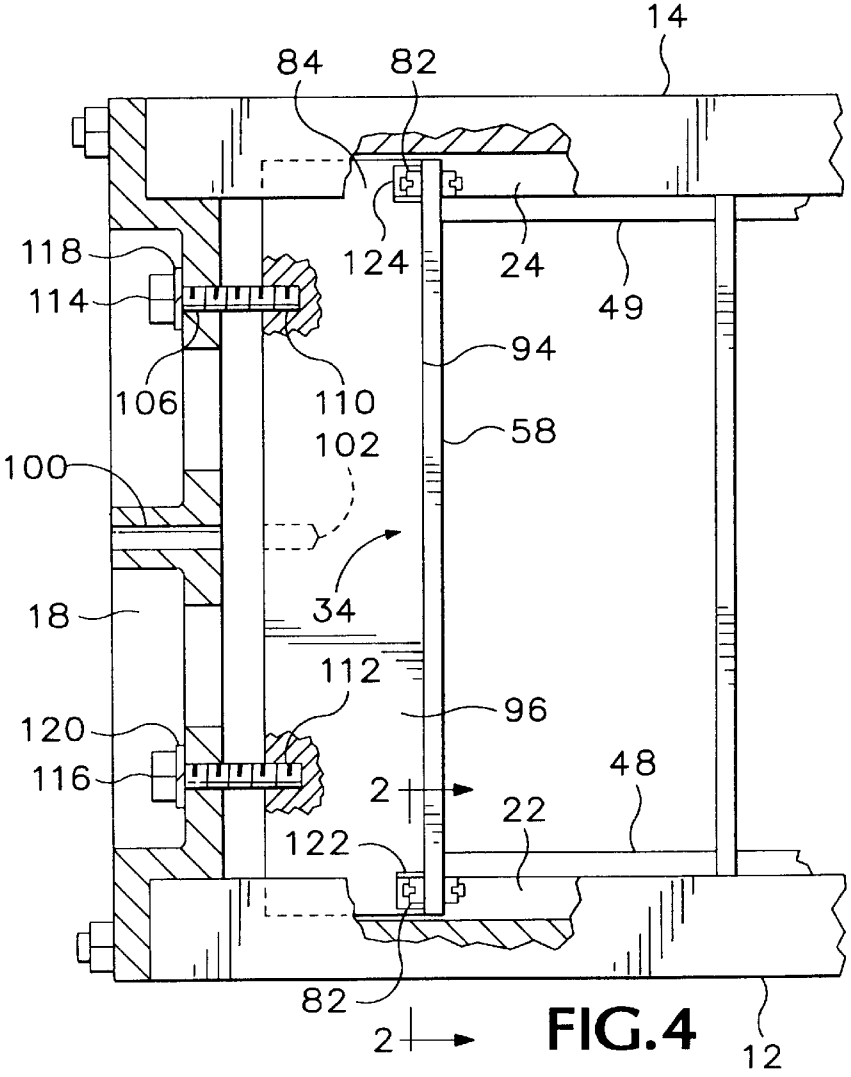
FIG. 4 is a top plan view, similar to FIG. 3, of the mold box assembly shown in partial cross section showing the sliding plate in a fully extended position fully received in a slot formed in the mounting bracket of the mold box, in a condition when the mold box is mounted ready for receiving cement product.
Figure 3:
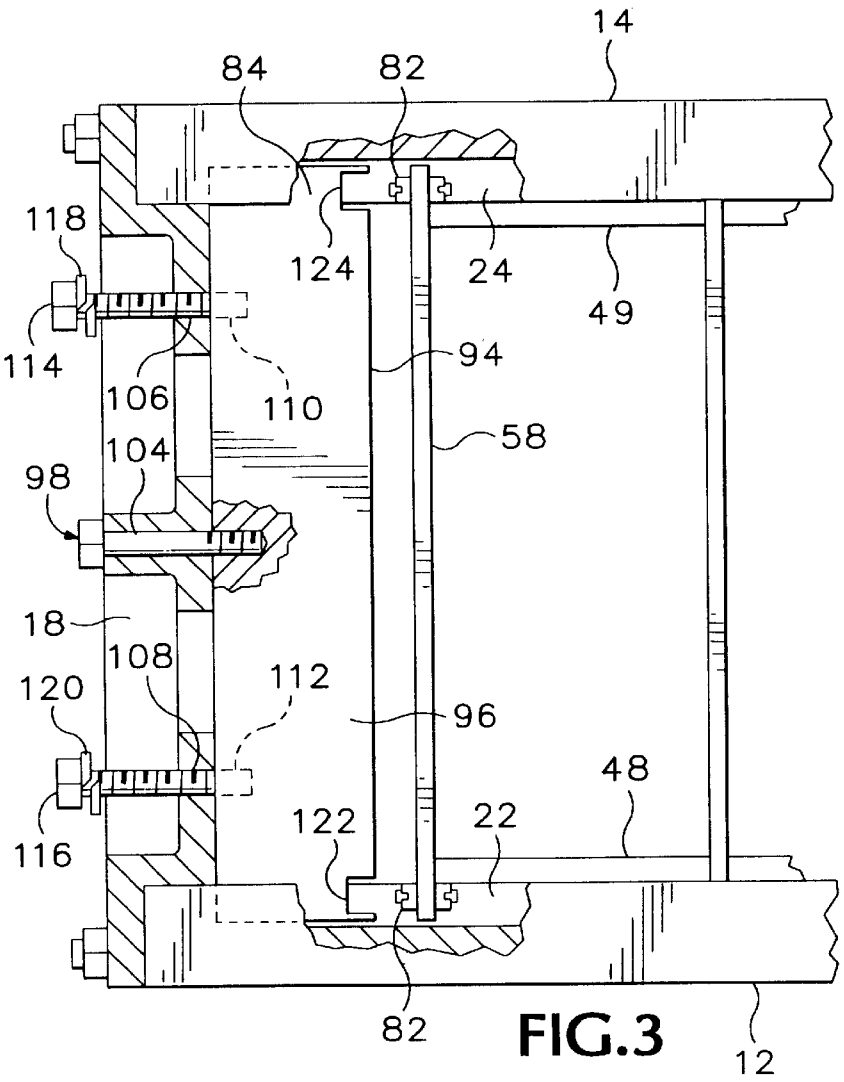
FIG. 3 is a top plan view of the mold box assembly shown in FIG. 1, shown in partial cross section, illustrating a condition where a sliding plate is in a fully retracted position in order to accommodate exchange of mold box assemblies.

As best seen in FIGS. 3 and 4, a retractor, such as retractor 98, is included in assembly 10 for moving spacer 84 in order to adjustably accommodate various arrangements of liners and partitions within assembly 10. Another retractor, not visible in the drawings, can be located at the opposite end of mold box assembly 10 and is substantially identical to retractor 98. Retractor 98 includes a bore 100 disposed centrally in frame end bracket 18, and a threaded bore 102, disposed centrally in a side of spacer 84, with the bore and the threaded bore being coaxial with respect to each other. Retractor 98 further includes an associated bolt 104, which is threaded adjacent its end so as to engage spacer 84 when the bolt is fully extended through the bores.

Each frame end bracket, such as end bracket 18, further includes a pair of threaded bores, such as bores 106, 108 (FIGS. 3 and 4), spaced apart from each other, and each spacer, such as spacer 84, has a pair of corresponding bores having ends, such as bores 110, 112, disposed in the spacer, with the threaded bores in the end brackets and the bores in the spacers being coaxial with respect to each other. A pair of associated bolts threaded adjacent their heads, such as bolts 114, 116, are provided to engage the threaded bores, such as bores 106, 108, in the end brackets, such as end bracket 18, when the bolts are fully extended through the end brackets with the ends of the bolts abutting the ends of the spacer bores, such as spacer bores 110, 112. Lock washers, such as washers 118, 120, are provided for each bolt, such as bolts 114, 116, to lock the bolts in place, as shown in FIG. 4.

A liner and partition arrangement which is substantially shorter than the end plates of the mold box may be adapted by the method of the invention by removing one of the frame end brackets, such as end bracket 18, and installing an arrangement of liners (such as plates 48,49) and partitions (such as partition plates 54,56,58). Then, one installs within the frame one of a pair of spacers, such as spacer 84, with the expanses of each spacer received in the slots, such as slots 22, 24, of end plates 12, 14 to slidably travel therealong. The end bracket is then fixedly mounted on the ends of the frame end plates. The retractor 98 retractably moves spacer 84 to accommodate the assorted arrangements of liners and partition plates, in assembly 10. Bolt 98 is threaded through central bore 100 on the frame end bracket and into threaded bore 102 to engage spacer 84, and move the spacer outwardly toward the frame end brackets, as best seen in FIG. 3. The liners and partition plates are placed in the frame, and the spacers are slid into the slots on the mounting brackets of the mold box by movement of bolts, such as bolts 114, 116 through threaded bores 106, 108 in the end brackets, such as mounting bracket 18, with the ends of the bolts abutting the end of the spacers bores, such as spacer bores 110, 112. The lock washers, such as washers 118, 120 then are engaged to lock the bolts in place, as shown in FIG. 4. So positioned, the spacer abuts the outer partition plate, such as partition plate 58, to thereby fixedly maintain the partition plate in its selected position whereupon the mold is ready to be filled with wet cement material.

It can thus be seen that the structure and method provided by the present invention produces important advantages. First, the vertical vibration forces imparted to mold box assembly 10 during operation are distributed over a relatively larger area. Specifically, the leading side 94 of spacer 84 is substantially flushly abutted against one side of partition plate 58. Similarly, top and bottom surfaces of spacer 84 are substantially flushly abutted against the top and bottom edges of slots 22, 24. Vertical vibration forces set up in the mold box assembly are thus spread over a larger area than if the liners and partitions were, e.g., simply bolted to mold box support frame 14 at several locations. When bolts are used, as in prior art adapters, only the heads of the bolt resist upward forces imparted to the liners and partition plates.

Another advantage of the present invention relates to the ease of changing partition arrangements, out of the support frame and mounting a different arrangement therein. To achieve the same, bolts 114, 116 are unscrewed from the position of FIG. 4 to that of FIG. 3 and bolt 104 is inserted through bore 100 and into threaded bore 102. Threaded bolt 104 moves spacer 84 from the configuration shown in FIG. 4 to that of FIG. 3. When the same procedure preformed on the structure associated with a spacer at the opposite end of the assembly, both spacers are withdrawn to the position of FIG. 3, and the mounting bracket 18 (and optionally 16) to be removed from end plates 12, 14. The partition plates and liners to be installed are inserted into frame 14 in the arrangement desired depending upon the dimension and number of molded products desired. The mounting bracket 18 is then mounted back onto the frame 14 as shown in FIG. 3. Thereafter, bolt 104 (in FIG. 3) is removed, bolts 114, 116 are screwed in to slide spacer 84 into bores 106, 108 in the configuration shown in FIG. 4. Substantially the same procedure is performed on the structure at the opposite end of assembly 14 to urge the optional spacer (not shown) into the slots 22,24 and against the outer partition plate in the same fashion that spacer 84 is urged against partition plate 58.

Figure 5:
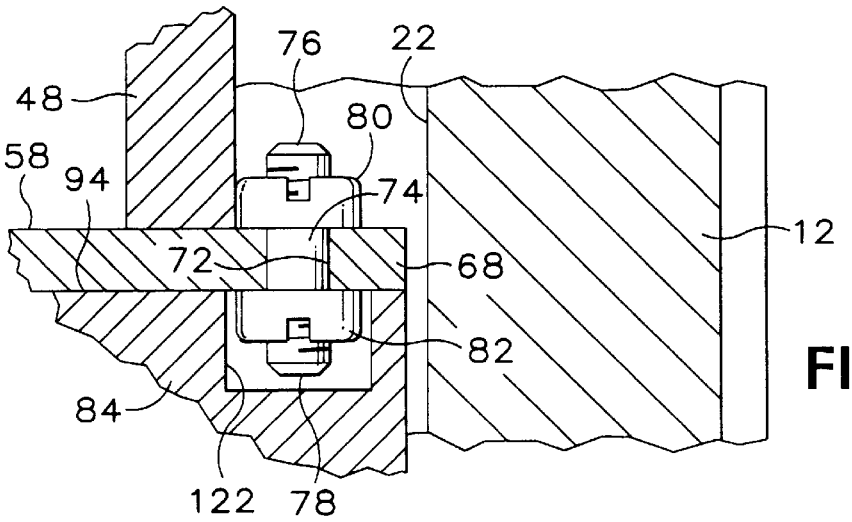
FIG. 5 is a further slightly enlarged sectional view taken along lines 5—5 in FIG. 2.

Spacer 84 includes cutouts 122, 124 on the leading side 94 thereof for receiving the locking means disposed on the tabs of the outer partition plate, such as ring nut 82 on tab 68 of partition plate 58. As can be seen at FIG. 5, ring nuts 80, 82 each bear against end liner 46, and an inner surface of cutout 122 respectively. The ring nuts and stud (not visible) mounted on the tab on the opposite end of partition plate 58, and received in slot 24, are similarly urged against surfaces of end liners 50 and cutout 124.

The spaces between the partition plates in the mold box assembly 10 provide cavities into which wet concrete is compressed and thereafter stripped therefrom to form a molded concrete product. It can thus be seen that a product of varying width can be made using mold box assembly 10 by substituting end liners having a different width than those shown in FIG. 1. It can also be seen with reference to FIG. 5 that each of the end plates 12,14 are constrained against bowing outwardly during compression because the ring nuts on either end of the partition plates are flushly abutting an associated end liner or spacer.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. An adjustable mold box assembly for accommodating tolerances in a mold, comprising:

a first end plate;

a second end plate opposite said first end plate and being substantially parallel therewith;

at least one partition plate extending from one end plate to the other and having first and second opposing ends which substantially abut an inner side of the end plates;

a slot formed on the inner side of said first end plate and extending substantially along the length thereof;

a tab extending from one end of said partition plate, said tab being received in said slot, said partition plate being slidable along said slot when said tab is received in said slot;

a first end liner mounted on said first end plate over said slot adjacent one side of said partition plate; and a spacer moveable to an operative position intermediate the other side of said partition plate, said first end liner and said spacer together constraining movement of said partition plate relative to said slot when said spacer is in operative position.

2. The mold box of claim 1 wherein said spacer includes first and second ends and a substantially rectangular member having an expanse extending from a first end, with said expanse being received in said slot and slidably traveling therealong.

3. The mold box of claim 2, further comprising a second elongate slot formed on the inner side of said second end plate and extending substantially along the length thereof, and wherein said member further includes a second expanse extending from the second end of the spacer, with said second expanse being received in said second slot and slidably traveling therealong.

4. The mold box of claim 1, further comprising a retractor coupled to the spacer to move said spacer relative to said partition plate.

5. The mold box of claim 4 further including a pair of opposed, substantially parallel end brackets positioned at opposite ends of the first and second end plates, wherein said retractor includes a bore disposed centrally in said one end bracket, a threaded bore disposed centrally in a side of said spacer, with said bore and said threaded bore being coaxial with respect to each other, and an associated bolt threaded adjacent a bolt end so as to engage said spacer when said bolt is fully extended through said bores.

6. The mold box of claim 5, wherein said one end bracket further includes a pair of threaded bores spaced apart from each other and a pair of bores having ends disposed in said spacer, with said threaded bores and said bores in said spacer being coaxial with respect to each other, and a pair of associated bolts threaded adjacent their heads so as to engage said threaded bores in said end bracket when said bolts are fully extended through said end bracket with the ends of said bolts abutting the ends of said spacer bores.

7. The mold box of claim 1, wherein said mold box further comprises:

a second slot formed on the inner side of said second end plate and extending substantially along the length thereof;

a second tab extending from the other end of said partition plate, said second tab being received in said second slot, said partition plate being slidable along said second slot when said second tab is received in said slot; and a second end liner mounted on said second end plate over said second slot adjacent said one side of said partition plate, said second end liner and said spacer constraining movement of said partition plate relative to said second slot.

8. The mold box of claim 7, further comprising:

a second partition plate extending from one end plate to the other and having first and second opposing tabs which are received in said first and second end plate slots, said second partition plate further having one side positioned intermediate said first and second end liners;

a third end liner mounted on said first end plate over said slot adjacent the other side of said partition plate; and a fourth end liner mounted on said second end liner over said second slot adjacent said other side of said partition plate.

9. The mold box of claim 8, further comprising first locking means extending laterally from said first opposing tab of said second partition plate, said locking means bearing against each of said first and third end liners mounted on said first end plate.

10. The mold box of claim 9, further comprising second locking means extending laterally from said second opposing tab of said second partition plate, said second locking means bearing against each of said second and fourth end liners mounted on said second end plate.

11. The mold box of claim 1 wherein said spacer includes a cutout portion therein, the mold box further comprising locking means extending laterally from said tab of said partition plate, said locking means being received within said cutout of said spacer.

12. The mold box of claim 1, further comprising locking means extending laterally from said tab of said partition plate, said locking means bearing against each of said first end liner and said spacer.

* * * * *